United States Patent [19]

Smith et al.

[11] Patent Number: 4,673,239

[45] Date of Patent: Jun. 16, 1987

[54] TERMINAL BLOCK ASSEMBLY

[75] Inventors: John W. Smith, Indianapolis; Ellis P. Lipp, Charlottesville, both of Ind.

[73] Assignee: Emhart Industries, Inc., Indianapolis, Ind.

[21] Appl. No.: 902,096

[22] Filed: Aug. 27, 1986

Related U.S. Application Data

[63] Continuation of Ser. No. 814,280, Dec. 23, 1985, abandoned, which is a continuation of Ser. No. 669,523, Nov. 8, 1984, abandoned.

[51] Int. Cl.[4] ..... H01R 13/432; H01R 13/426

[52] U.S. Cl. ..... 439/746; 439/744

[58] Field of Search ..... 339/217 S, 217 R

[56] References Cited

U.S. PATENT DOCUMENTS

| | | | |
|---|---|---|---|
| 2,964,725 | 12/1960 | Lehr et al. | 339/217 R |
| 3,122,407 | 2/1964 | Cowe | 339/217 R |
| 3,514,745 | 5/1970 | DeLyon | 339/217 S |
| 3,753,193 | 8/1973 | Teagno et al. | 339/217 S |
| 4,262,981 | 4/1981 | Goodman | 339/17 C |

FOREIGN PATENT DOCUMENTS

| | | | |
|---|---|---|---|
| 656176 | 3/1965 | Belgium | 339/217 S |
| 2424443 | 12/1974 | Fed. Rep. of Germany | 339/217 S |

*Primary Examiner*—Eugene F. Desmond
*Assistant Examiner*—Gary F. Paumen
*Attorney, Agent, or Firm*—Robert F. Meyer

[57] ABSTRACT

An electrical contact blade and an electrical terminal are locked together within two intersecting slots provided in a terminal block, and at least one of either the electrical terminal or the electrical contact blade is prevented from axial movement in a predetermined direction by a stop provided in its respective slot.

3 Claims, 3 Drawing Figures

TERMINAL BLOCK ASSEMBLY

This application is a continuation of application Ser. No. 814,280, filed Dec. 23, 1985, now abandoned, which is a continuation of Ser. No. 669,523, filed Nov. 8, 1984, now abandoned.

BACKGROUND OF THE INVENTION

The present invention relates to a terminal block assembly wherein there is a positive locking of an electrical terminal to an electrical contact blade.

The present invention is particularly useful in switches wherein a good electrical contact needs to be provided between an electrical contact blade and an electrical terminal.

SUMMARY OF THE INVENTION

Accordingly, there is provided a terminal block assembly wherein an electrical terminal is positively locked to an electrical contact blade. In general, the terminal block assembly comprises a terminal block, at least two intersecting slots in the terminal block, a electrical terminal and an electrical contact blade individually carried in respective slots of the two intersecting slots, locking means carried by said electrical terminal and electrical contact blade and locking them together within the two intersecting slots, and stops means carried in at least one of the two intersecting slots to prevent movement of its respective electrical terminal or electrical contact blade in a predetermined direction.

DETAILED DESCRIPTION OF THE DRAWINGS

Figure 1:
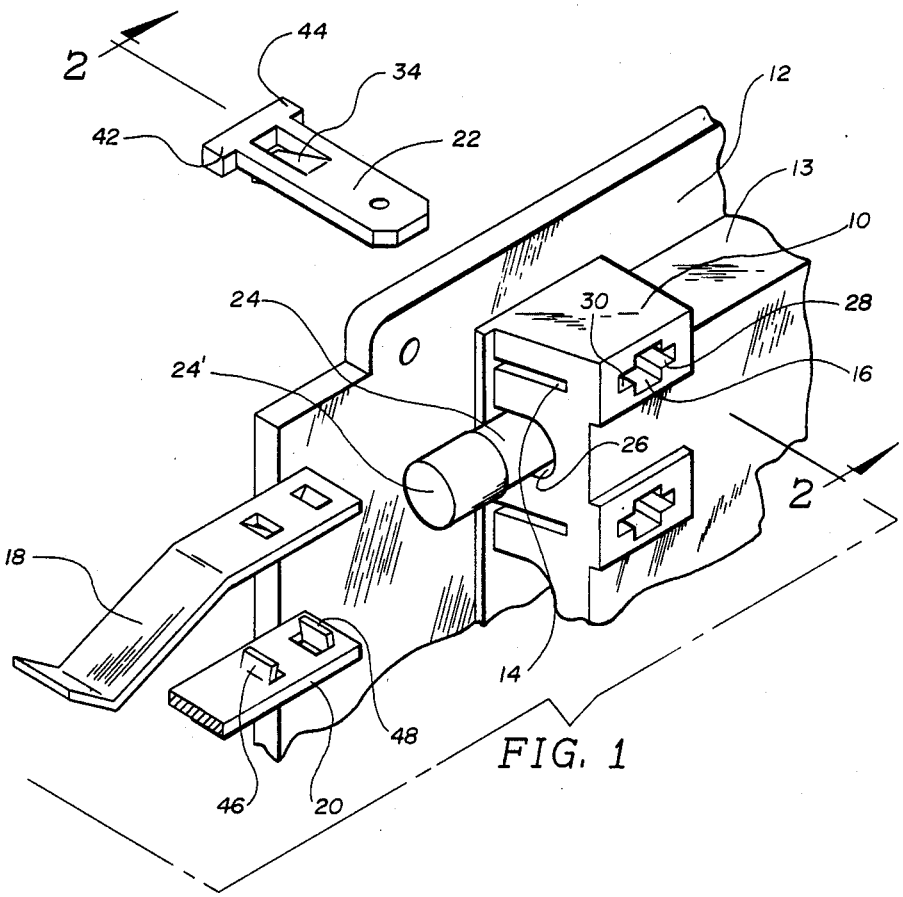
FIG. 1 is an exploded view of a terminal block assembly illustrating the features of the invention.

Referring now to the drawings, there is shown a terminal block 10 that is integral with or otherwise connected to a base plate 12. Plate 12 could be a wall of a switch housing 13, for example.

Terminal block 10 includes intersecting slots 14 and 16 into which two electrically conductive members such as contact blades 18, 20 and electrical terminals 22 (one shown) can be inserted. An electrical connection between the contact blades could be made through a mechanically actuated plunger 24 having an electrically conductive metal cap 24', for example, which slides through opening 26.

Figure 2:
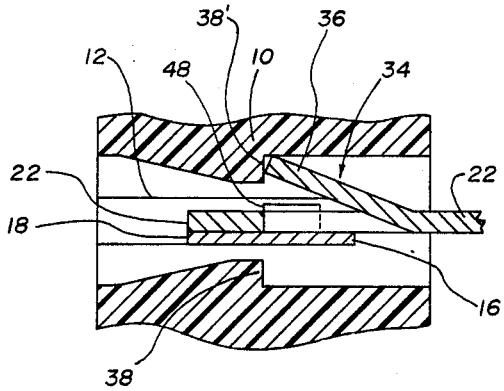
FIG. 2 is a section taken along the line 2—2 of FIG. 1.

Slot 16 extends completely through terminal block 10 and plate 12 to receive electrical terminal 22. The terminal is carried in oppositely disposed grooves 28 and 30 formed in the walls of the slot. A stop means 34 prevents the terminal from moving out of the slot in the direction from which it entered the slot. Stop means 34 includes an annular rib 38 which engages a barb 36 that is lanced from the terminal and which is spring biased to spring over the annular rib (FIG. 2). The terminal is thus prevented from moving in the direction from which it entered the slot.

Electrical contact blade 18 (or 20) is carried in slot 14. In assembling the electrical terminal and the electrical contact blade in the terminal block, electrical contact blade is first inserted into slot 14, the depth to which it is inserted being limited by the depth of the slot. Electrical terminal 22 is then inserted into slot 16 by way of grooves 28 and 30 and, as shown in FIG. 2, when barb 36 reaches the drop edge 38' of rib 38, it springs outwardly so that it is prevented from moving in the direction from which it entered the slot.

Figure 3:
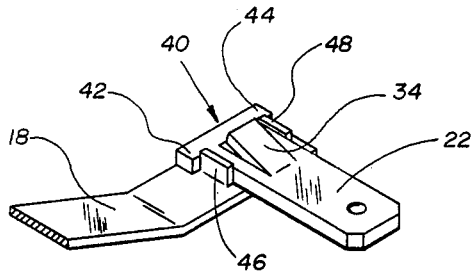
FIG. 3 is a view showing an electrical terminal locked to an electrical contact blade in accordance with the invention.

As best shown in FIGS. 1 and 3, when the terminal and the blade are assembled they are locked together by locking means 40. Locking means 40 includes lugs 42 and 44 which are carried by electrical terminal 22 and lugs 46 and 48 carried by the electrical contact blades 18 and 20. Lugs 46 and 48 are lanced from the electrical contact blades and are spring biased such that as the electrical terminal slides between them as it enters slot 16, the lugs are biased outwardly to provide a tight engagement with the sides of the electrical terminal. FIG. 3 illustrates the relationship of the electrical terminal and the electrical contact blade as they are locked together within the intersecting slots 14 and 16. As shown, electrical terminal 22 is prevented from further movement into the terminal block 10 through the engagement of lugs 42 and 44 with lugs 46 and 48 (FIG. 1), while contact blade 18 is prevented from moving out of the slot 14 through lugs 46 and 48 engaging terminal 22.

Thus the electrical terminal and the electrical contact blade are securely locked together within the intersecting slots 14 and 16.

What is claimed is:

1. A terminal block assembly comprising a terminal block, at least two intersecting slots in said terminal block, first and second electrically conductive contact members individually carried in respective slots of said two intersecting slots, lugs carried by each of said electrically conductive members and engaging each other, and stop means preventing one member of said first and second electrically conductive members from moving out of its respective slot, whereby said first and second electrically conductive members are locked together and both of said first and second electrically conductive members are prevented from coming out of their respective slot.

2. A terminal block assembly according to claim 1 wherein said terminal block includes a rib carried in one of said two intersecting slots and engaging its respective member of said two electrically conductive members.

3. A terminal block assembly according to claim 2 wherein said rib engages a barb lanced from said respective member.

* * * * *